US007241723B2

(12) United States Patent
Zhang et al.

(10) Patent No.: US 7,241,723 B2
(45) Date of Patent: Jul. 10, 2007

(54) BEARING CLEANING COMPOSITION AND METHOD OF USE

(75) Inventors: Ruiming Zhang, Coppell, TX (US); Anthony Peter Wenzler, Lewisville, TX (US); Michael Dennis Holloway, Lewisville, TX (US)

(73) Assignee: NCH Corporation, Irving, TX (US)

( * ) Notice: Subject to any disclaimer, the term of this patent is extended or adjusted under 35 U.S.C. 154(b) by 420 days.

(21) Appl. No.: 10/655,860

(22) Filed: Sep. 5, 2003

(65) Prior Publication Data

US 2005/0054541 A1 Mar. 10, 2005

(51) Int. Cl.

| | |
|---|---|
| ***C10M 159/20*** | (2006.01) |
| ***C10M 159/24*** | (2006.01) |
| ***C10M 171/00*** | (2006.01) |
| ***C10M 173/00*** | (2006.01) |
| ***C10M 173/02*** | (2006.01) |

(52) U.S. Cl. ..... 508/180; 508/179; 508/184; 508/391; 508/392; 508/399; 184/5; 184/5.1; 384/625

(58) Field of Classification Search ..... 508/180, 508/179, 184, 391, 392, 399; 184/5, 5.1; 384/625

See application file for complete search history.

(56) References Cited

U.S. PATENT DOCUMENTS

| | | | | |
|---|---|---|---|---|
| 2,160,214 A | | 5/1939 | Jackson | |
| 2,465,961 A | * | 3/1949 | Olphen | 508/532 |
| 3,021,182 A | * | 2/1962 | Schnacke | 384/473 |
| 3,717,222 A | | 2/1973 | Moline | |
| 4,113,059 A | | 9/1978 | Markovski | |
| 4,560,489 A | | 12/1985 | Muir et al. | |
| 4,727,619 A | | 3/1988 | Robbins | |
| 4,787,992 A | * | 11/1988 | Waynick | 508/163 |
| 4,810,396 A | * | 3/1989 | Jao et al. | 508/401 |
| 5,080,198 A | | 1/1992 | Rice | |
| 5,126,062 A | | 6/1992 | Barnes | |
| 5,308,514 A | | 5/1994 | Olson et al. | |
| 5,338,467 A | | 8/1994 | Olson et al. | |
| 5,676,708 A | * | 10/1997 | Smith | 8/521 |
| 5,992,569 A | | 11/1999 | Dawson | |

* cited by examiner

*Primary Examiner*—Patrick Niland
(74) *Attorney, Agent, or Firm*—Locke Liddell & Sapp, LLP

(57) ABSTRACT

A composition for cleaning bearings in rotating equipment and industrial machinery that contains powdered limestone having a high calcium content dispersed in a calcium sulfonate grease, together with a colorant that readily enables a user to differentiate between contaminated grease, cleaning composition and fresh grease. A method is also disclosed that enables a user to clean and re-lubricate bearings without the need for removing the bearings from service or for shutting down the associated equipment or machinery.

29 Claims, No Drawings

BEARING CLEANING COMPOSITION AND METHOD OF USE

BACKGROUND OF THE INVENTION

1. Field of the Invention

This invention relates to greases used for lubricating bearings in rotating equipment and machinery in automotive, industrial, construction and maritime applications. More particularly, the invention relates to a composition and method for cleaning such bearings and for replacing the bearing lubricant without the need for removing the bearings from service during the cleaning process.

2. Description of Related Art

Recommended procedures for maintaining the bearings used in rotating equipment and industrial machinery typically include two phases: periodic greasing (adding supplemental grease to a bearing), which is done at short-term service intervals as part of the normal lubrication schedule; and grease removal and repacking, which is done at relatively longer service intervals. In the past, grease removal and repacking has most often been done by shutting down the equipment or machinery, removing bearings from their journals, stripping the grease and contaminants from the bearings by hand-brushing with hydrocarbon solvents, and then laboriously repacking fresh grease into the bearings and re-assembling the bearing system. Hydrocarbon solvents pose well-known risks to workers and to the work environment because of their volatility and flammability.

Calcium sulfonate greases are typically available in one of two different types. The simple or uncomplexed form of calcium sulfonate grease was first invented and used in industrial applications in the early 1970's. The complexed calcium sulfonate greases were developed in the early 1980's and brought to market in the middle of that decade. Due to the superior properties of the complexed greases over the simple calcium sulfonate grease, most companies currently involved in calcium sulfonate grease production make the complexed greases. The technology used in producing the greases is described in numerous U.S. and foreign patents including, for example, U.S. Pat. Nos. 4,560,489; 5,126,062; 5,308,514 and 5,338,467. Other prior art compositions, apparatus and methods for flushing and repacking bearings are disclosed, for example, in U.S. Pat. Nos. 2,160,214; 3,717,222; 4,113,059; 4,727,619; 5,080,198; and 5,992,569.

A composition and method for cleaning and repacking bearings are needed, however, that do not require the use of complexed calcium sulfonate greases or of potentially harmful solvents, and that can be easily and efficiently employed during operation of the equipment or machinery, thereby reducing maintenance costs and simultaneously avoiding loss of production during equipment downtime.

SUMMARY OF THE INVENTION

The composition and method disclosed herein enable a user to clean old grease, dirt, dust, grime, fibers, corrosion, metal particles and other contaminants out of bearings and to replace the contaminated grease with fresh lubricant without shutting down the related equipment or machinery. The composition of the invention is preferably an overbased calcium sulfonate grease containing a powdered polishing agent having a high calcium content in combination with a readily identifiable colorant that enables the user to easily distinguish the cleaning composition from both the contaminated lubricant and the fresh grease. The subject composition is formulated to permit the bearing to remain in service while removing the old lubricant and cleaning the bearing.

According to the method of the invention, after a limited period of operation during which the subject composition thoroughly cleans the bearing and displaces the old lubricant, fresh grease is injected into the bearing journal to displace the cleaning composition and re-lubricate the bearing. Because the bearing remains in service throughout the cleaning and re-lubrication phases, both the cleaning composition and the fresh grease are distributed throughout the bearing without the need for solvent cleaning, hand-brushing, packing or other manipulation.

The composition of the invention has superior water resistance and exhibits unique burnishing action that mechanically polishes bearings while chemically cleansing them in a single treatment. The subject bearing cleaning composition safely removes varnish, lacquer and other deposits without damaging sensitive bearing surfaces and seals. The composition is suitable for use with mineral- or synthetic-based NLGI #1 and #2 grade greases, and is compatible with babbit bearings, bronze, brass, copper, silver and other alloys and plastic materials. The composition has high detergency, inhibits further rust and corrosion, reduces shock load in extreme pressure applications, extends bearing life by cleaning the entire bearing system, and is effective at operating temperatures ranging from 0° F. to 400° F.

DESCRIPTION OF THE PREFERRED EMBODIMENTS

The composition of the invention is developed from a formulation for a simple, uncomplexed calcium sulfonate grease. The overbased nature of simple calcium sulfonate grease provides the necessary detergency for cleaning the carbonaceous deposits from bearing systems. A soft mineral powder, preferably ground marble, acts in combination with the grease to polish the bearings while removing contaminants from around the bearings. A colorant, preferably an orange-colored dye, is provided in the formulation for use as a visual indicator so the user will know when the subject composition is present in the bearing assembly.

The compositions of the invention preferably comprise from about 30 to about 80 weight percent solvent neutral oil, from about 30 to about 80 weight percent overbased calcium sulfonate, from about 3 to about 15 weight percent powdered polishing agent such as calcium carbonate, from about 1 to about 5 weight percent alkylbenzene sulfonic acid, from about 1 to about 3 weight percent hexylene glycol, and from about 0.1 to about 1 weight percent colorant. Most preferably, the compositions of the invention comprise from about 8 to about 10 weight percent powdered calcium carbonate. During manufacture, from about 1 to about 8 weight percent water, most preferably about 5 weight percent cold water, are added to the other components. However, as discussed in greater detail below, most if not all of that water evaporates as the composition is mixed under atmospheric conditions at temperatures exceeding the boiling point of water.

A preferred solvent neutral oil for use in the compositions of the invention has a specific gravity of about 0.88, a boiling point of about 635° F. and a viscosity of about 600 SUS at 100° F. A preferred overbased calcium sulfonate for use in the compositions of the invention preferably has a specific gravity of about 1.2 and comprises about 20 weight percent calcium sulfonate, about 15 weight percent calcium, and has a total base number (ASTM D 2896) of about 400. A preferred alkylbenzene sulfonic acid for use in the invention comprises about 96 weight percent $C_{10}$-$C_{16}$ alkylbenzene sulfonic acid and a minor amount of sulfuric acid, and has a specific gravity of about 1.05 and a boiling point of about 201° F. A preferred colorant for use in the invention is an azo dye. A particularly preferred colorant is 2-Napthalenol, 1-(phenylazo).

A preferred polishing agent for use in the invention is a finely-divided, free-flowing calcium carbonate powder, sometimes referred to as powdered marble or marble dust. A particularly preferred material for use as the polishing agent is a micro-pulverized product of high-purity sugar calcite having a hexagonal crystalline structure with a particle shape that is irregular and a mean particle size of about 2.5 microns. Minor amounts, typically up to about 2 wt. percent of the powder in combined weight, of impurities such as magnesium carbonate, silicon dioxide, aluminum oxide, iron oxide and manganese oxide can also be present in the preferred polishing agent of the invention. Where the amount of polishing agent approaches the low end of the stated range, or about 3 weight percent, the resultant composition will exhibit reduced cleaning effectiveness and is more expensive to manufacture because additional overbased calcium sulfonate, a more expensive ingredient than powdered marble, is desirably used in place of the reduced polishing agent. On the other hand, where the amount of polishing agent approaches the upper end of the stated range, or about 15 weight percent, the resultant composition is less expensive to produce but is more abrasive and possibly less desirable, especially for use with bearings made of relatively softer metals.

The compositions of the invention are preferably made by charging approximately three-fourths of the solvent neutral oil and all the overbased calcium sulfonate to a kettle, starting agitation, and then adding the powdered calcium carbonate polishing agent. After stirring the resultant mixture for at least 10 minutes, the alkylbenzene sulfonic acid is added, followed by another 20 minutes of stirring. The hexylene glycol and cold water are then added to the mixture, heated to a temperature ranging from about 220 to about 250° F., and allowed to cool to about 200 to 220° F. At this stage, a sample is desirably milled for a penetration check (ASTM D 217). If penetration is less than 310, approximately 5 weight percent more solvent neutral oil is added at a time until pen is in the 310 to 330 range. The subject grease is next transferred to a finishing kettle where the colorant is added and the grease is mixed and circulated for at least one hour prior to storage or packaging.

EXAMPLE 1

Using the procedures set forth above, a mixture is produced by combining, mixing and heating 42.7 wt. % solvent neutral oil, 42.5 wt. % calcium sulfonate, 8.6 wt. % powdered marble, 4 wt. % alkylbenzene sulfonic acid, 2 wt. % hexylene glycol, 5 wt. % cold water and 0.2 wt. % azo dye. During heating and mixing, the water evaporates, leaving the stated amounts of the other components in the resultant bearing cleaning composition.

EXAMPLE 2

Using the procedures set forth above, a mixture is produced by combining, mixing and heating 42.7 wt. % solvent neutral oil, 48.1 wt. % calcium sulfonate, 3 wt. % powdered marble, 4 wt. % alkylbenzene sulfonic acid, 2 wt. % hexylene glycol, 5 wt. % cold water and 0.2 wt. % azo dye. During heating and mixing, the water evaporates, leaving the stated amounts of the other components in the resultant bearing cleaning composition.

EXAMPLE 3

Using the procedures set forth above, a mixture is produced by combining, mixing and heating 38.8 wt. % solvent neutral oil, 40 wt. % calcium sulfonate, 15 wt. % powdered marble, 4 wt. % alkylbenzene sulfonic acid, 2 wt. % hexylene glycol, 5 wt. % cold water and 0.2 wt. % azo dye. During heating and mixing, the water evaporates, leaving the stated amounts of the other components in the resultant bearing cleaning composition.

Although the same amounts of alkylbenzene sulfonic acid, hexylene glycol and azo dye are used in the three compositions of the invention as set forth above, it should be understood that the amounts of those components can likewise be varied within the ranges set forth above to produce acceptable compositions of the invention. The alkylbenzene sulfonic acid acts as a catalyst in the phase transition of the composition from a Newtonian fluid to a Non-Newtonian grease-like composition. This phase transition is associated with the conversion of non-crystalline calcium carbonate particles in overbased calcium sulfonate to crystalline wafer-like calcite particles. A particularly preferred range of alkylbenzene sulfonic acid is from about 3 weight percent to about 4 weight percent. Where the amount of alkylbenzene sulfonic acid approaches the low end of the stated range, or about 1 weight percent, the phase transition of calcium carbonate particles from amorphous to crystalline is very slow, though giving enough reaction time, the same final state will be reached. But considering production efficiencies, such a slow process is not desirable. On the other hand, where the amount of alkylbenzene sulfonic acid approaches the upper end of the stated range, or about 5 weight percent, the rate of conversion from Newtonian fluid to grease-like composition will be fast. However, excess acid will neutralize a large portion of the overbased calcium sulfonate and, as a result, the thickening efficiency will be reduced and additional overbased calcium sulfonate will be needed to achieve same consistency in the final grease composition.

The hexylene glycol acts as a co-catalyst to facilitate the phase transition of amorphous calcium carbonate particles to crystalline calcite particles. Traditionally, isopropyl alcohol or other volatile polar solvents were used, but such polar solvent will vaporize along with water as temperature is raised above boiling point of water. Due to emission concerns associated with use of such volatile polar solvents, hexylene glycol is used as a preferred, less-volatile replacement. After the cooking process, water is evaporated from the composition while hexylene glycol is left in the final grease composition. Because its only function is to co-catalyze the phase transition and because it is left in the final grease composition, its particularly preferred range is from about 1 weight percent to about 2 weight percent. Where the amount of hexylene glycol is lower than about 1 weight percent, it is probably not sufficient to help in the phase transition process. On the other hand, where the amount of hexylene glycol approaches the upper end of the stated range, or about 3 weight percent, due to its polar nature and intrinsic water affinity, the final grease composition can be less water resistant, which is obviously not desirable.

Water functions very similarly as hexylene glycol, which is to provide a polar environment to facilitate the conversion of the original Newtonian fluid to a grease-like composition. A particularly preferred range of water content is from about 4 weight percent to 5 weight percent, by weight of the combined reactant. Where the amount of water approaches the low end of the stated range, or about 1 weight percent, the phase transition will be slow or even incomplete. On the other hand, where the amount of water approaches upper end of the stated range, or about 8 weight percent, though it probably will not adversely affect the grease properties, since most of the water will evaporate once temperature is raised to about 250° F., more energy will be consumed in the cooking process to dry the final grease composition by water evaporation.

The amount of colorant required in the compositions of the invention is desirably a minor amount that is effective to produce a readily identifiable color in the resultant bearing cleaning composition. If the colorant is an azo dye and if the amount of azo dye used in the compositions of the invention is less than about 0.1 weight percent, the color of the bearing cleaning composition may not be readily identifiable, especially when the composition is dirty as it is being flushed from the bearing assembly. Amounts of azo dye greater than about 1 weight percent are generally not needed in order to produce an identifiable color change, although it will be appreciated that the amount of colorant required to produce a cleaning composition that is readily identifiable visually will depend upon the type, color and color intensity of the colorant material.

The physical properties of a preferred composition of the invention were further investigated using the composition of EXAMPLE 2, with the results set forth in the following table:

PHYSICAL PROPERTIES

| Test | Results | Method |
|---|---|---|
| Dropping Point (° F.) | 580 | ASTM D2265 |
| Penetration | | |
| unworked 0 strokes | 330 | ASTM D217 |
| worked 60 strokes | 337 | |
| worked 10,000 strokes | 337 | |
| Water Washout percent loss @ 175° F. | 0 | ASTM D1264 |
| Rust Test Rating, modified sea water | 1,1,1 pass | ASTM D1743 |
| Oil Separation 24 hrs @ 77° F., % | 0 | ASTM D1742 |
| Wheel Bearing Leakage, % loss @ 220° F. | 11.01 g., 12.2% | ASTM D1623 |
| Timken OK Load, lbs | 50 | ASTM D2509 |
| Four Ball Wear, scar diameter, mm. | 0.633 | ASTM D2266 |
| Four Ball Weld Point, kg | 400 | ASTM D2596 |
| Load Wear Index | 74.4 | ASTM D2596 |
| Copper Corrosion | 1a | ASTM D130 |
| Grease Mobility @ 0° F., g/min | 11.14 | USX |

The preferred useable temperature range for the preferred bearing cleaning composition of the invention is 0° F. to 400° F., with 350° F. being the highest recommended maximum temperature for continuous use, and 400° F. being the maximum for intermittent use only. The subject composition is compatible with most greases but is not recommended for use with clay or polyurea greases, although it can still be used to remove those greases out of a bearing system.

Bearing systems suitable for use with the compositions of the invention are desirably provided with a grease zert or other similarly effective means for introducing the subject compositions into the bearing under pressure and thereby displacing the contaminated grease that is already present in the bearing. One preferred tool for use in forcing the subject bearing cleaning composition into a bearing is a conventional, handheld grease "gun" that has a hose with a fitting on the free end that is attachable to a grease zert. Such handheld grease guns utilize a handle-driven piston to expel the cleaning composition from an elongated cylindrical package into the hose and from the hose, through the grease zert and into the bearing system.

According to a preferred method of the invention, bearing assemblies containing used and contaminated lubricant are filled with the subject bearing cleaning composition, which is preferably colored orange to make it readily identifiable and distinguishable from both the contaminated and replacement greases. The bearing assemblies desirably remain in service and operating throughout practice of the subject method. Once the orange composition has displaced and flushed the old contaminated grease out of the bearing assembly, as will be evident when all material being expelled from the side of the bearing assembly opposite the zert is orange, the bearing is allowed to remain in service for a run period of at least about 4 hours, and preferably from about 4 to about 8 hours. During that period, the polishing agent in the cleaning composition will desirably cause contaminants remaining inside the bearing assembly to be loosened or abraded from metal surfaces inside the assembly and to be suspended in the cleaning composition. To maximize cleaning effectiveness, additional bearing cleaning composition is desirably injected into the bearing system about halfway through the run period in order to flush out deposits displaced up to that point in the cleaning cycle, although this step is not required in order to obtain many benefits of the invention. At the end of the run period, and with the bearing still in operation, the cleaning composition is desirably flushed from the interior of the bearing system or assembly by re-lubricating with clean grease of the type normally used during regular service. Injection of clean grease should be continued until the now-dirty orange colored grease is no longer being expelled from the opposite side of the bearing assembly. As with all greases, care should be taken to avoid contamination of fresh supplies of the bearing cleaning composition when not in use.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventors are legally entitled.

We claim:

1. A bearing cleaning composition comprising an overbased calcium sulfonate grease, from about 3 to about 15 weight percent polishing agent, from about 1 to about 5 weight percent alkylbenzene sulfonic acid, and a minor effective amount of a colorant.

2. The composition of claim 1 wherein the overbased calcium sulfonate grease further comprises from about 30 weight percent to about 80 weight percent solvent neutral oil.

3. The composition of claim 2 wherein the solvent neutral oil has a viscosity of about 600 SUS at 100° F.

4. The composition of claim 1 wherein the overbased calcium sulfonate grease further comprises from about 30 weight percent to about 80 weight percent overbased calcium sulfonate.

5. The composition of claim 1 wherein the overbased calcium sulfonate has a total base number of about 400.

6. The composition of claim 1 wherein the alkylbenzene sulfonic acid comprises $C_{10}$-$C_{16}$ alkylbenzene sulfonic acid.

7. The composition of claim 1 wherein the grease further comprises from about 1 weight percent to about 3 weight percent hexylene glycol.

8. The composition of claim 1 comprising from about 3 to about 10 weight percent polishing agent.

9. The composition of claim 8 comprising from about 8 to about 10 weight percent polishing agent.

10. The composition of claim 1 wherein the polishing agent comprises powdered crystalline calcium carbonate.

11. The composition of claim 10 wherein the polishing agent consists essentially of powdered calcium carbonate.

12. The composition of claim 10 wherein the polishing agent is marble dust.

13. The composition of claim 1 wherein the polishing agent has a mean particle size of about 2.5 microns.

14. The composition of claim 1 wherein the colorant is an azo dye.

15. The composition of claim 1 wherein the azo dye is 2-Napthalenol, 1-(phenylazo).

16. The composition of claim 1 wherein the colorant is present in an amount ranging from about 0.1 weight percent to about 1 weight percent.

17. A bearing cleaning composition made by combining from about 30 to about 80 weight percent solvent neutral oil, from about 30 to about 80 weight percent overbased calcium sulfonate, from about 3 to about 15 weight percent powdered crystalline calcium carbonate, from about 1 to about 5 weight percent alkylbenzene sulfonic acid, from about 1 to about 3 weight percent hexylene glycol; from about 1 to about 8 weight percent water, and from about 0.1 to about 1 weight percent colorant.

18. The composition of claim 17 wherein the colorant is an azo dye.

19. The composition of claim 18 wherein the azo dye is 2-Napthalenol, 1-(phenylazo).

20. The composition of claim 17 comprising from about 8 to about 10 weight percent powdered crystalline calcium carbonate.

21. The composition of claim 17 wherein the powdered calcium carbonate is powdered marble.

22. The composition of claim 21 wherein the powdered marble is marble dust.

23. A method for removing contaminated grease from and for cleaning bearings disposed inside of a bearing assembly while the bearing assembly is in service, the method comprising the steps of:

injecting into the bearing assembly at an injection site a sufficient amount of a visually identifiable bearing cleaning composition to flush contaminated grease from the bearing assembly and render the bearing cleaning composition visible from a side of the bearing assembly disposed opposite the injection site, the bearing cleaning composition comprising overbased calcium sulfonate grease, powdered crystalline calcium carbonate, from about 1 to about 5 weight percent alkylbenzene sulfonic acid, and a colorant;

removing one or more contaminants from the bearing assembly by operating the bearing assembly continuously for a run period of at least about 4 hours with the bearing cleaning composition; and thereafter flushing the bearing cleaning composition from the bearing assembly by injecting fresh replacement grease into the bearing assembly until the bearing cleaning composition is no longer exuded from the bearing assembly.

24. The method of claim 23 comprising the additional step of injecting additional bearing cleaning composition into the bearing assembly during the run period.

25. The method of claim 23 wherein the run period lasts from 4 to about 8 hours.

26. The method of claim 23 wherein the injection site is a grease zert.

27. The method of claim 23 wherein the bearing cleaning composition comprises from about 3 to about 15 weight percent powdered calcium carbonate.

28. The method of claim 27 wherein the bearing cleaning composition comprises from about 8 to about 10 weight percent powdered calcium carbonate.

29. The method of claim 23 wherein the colorant is an azo dye.

* * * * *